US006806246B2

(12) United States Patent
Preissner et al.

(10) Patent No.: US 6,806,246 B2
(45) Date of Patent: Oct. 19, 2004

(54) BLEACH ACTIVATORS WITH IMPROVED SOLUBILITY

(75) Inventors: Karl Matthew Preissner, Cincinnati, OH (US); Angelica Damaris Brown, Fairfield, OH (US)

(73) Assignee: Procter & Gamble Company, Cincinnati, OH (US)

( * ) Notice: Subject to any disclaimer, the term of this patent is extended or adjusted under 35 U.S.C. 154(b) by 26 days.

(21) Appl. No.: 10/149,879

(22) PCT Filed: Dec. 20, 2000

(86) PCT No.: PCT/US00/34699

§ 371 (c)(1),
(2), (4) Date: Jun. 14, 2002

(87) PCT Pub. No.: WO01/46372

PCT Pub. Date: Jun. 28, 2001

(65) Prior Publication Data

US 2003/0017956 A1 Jan. 23, 2003

Related U.S. Application Data

(60) Provisional application No. 60/172,743, filed on Dec. 20, 1999.

(51) Int. Cl.[7] ..... C11D 1/00; C11D 3/26; C11D 3/39; C11D 3/395

(52) U.S. Cl. ..... 510/311; 510/315; 510/349; 510/376; 510/377; 510/378; 252/186.27; 252/186.28

(58) Field of Search ..... 510/309, 311, 510/315, 349, 376, 377, 378, 505; 252/186.27, 186.38

(56) References Cited

U.S. PATENT DOCUMENTS 4,678,594 A * 7/1987 Parfomak et al. ..... 252/186.31
4,921,631 A * 5/1990 Gradwell et al. ..... 252/186.38
6,214,785 B1 * 4/2001 Himmrich et al. ..... 510/444

FOREIGN PATENT DOCUMENTS

DE 28 55 777 A 6/1979
DE 41 43 016 A 7/1993

* cited by examiner

*Primary Examiner*—Gregory R. Del Cotto
(74) *Attorney, Agent, or Firm*—James F. McBride; Kim W. Zerby; Steve W. Miller

(57) ABSTRACT

The present invention relates to bleach activator particles that are useful in compositions such as detergent compositions. The present invention also encompasses detergent compositions containing such particles.

8 Claims, No Drawings

BLEACH ACTIVATORS WITH IMPROVED SOLUBILITY

CROSS REFERENCE TO RELATED APPLICATION

This application claims priority to Provisional Application Ser. No. 60/172,743, filed Dec. 20, 1999.

TECHNICAL FIELD OF THE INVENTION

The invention relates to bleach activator particles which have improved solubility and performance in an aqueous wash liquor. The present invention also encompasses detergent compositions utilizing these particles.

BACKGROUND OF THE INVENTION

It is well known that by adding surface bleaching components to a detergent composition that the detergent composition's cleaning performance can be improved. Bleaches are useful for removing dingy soils (which is usually a mixture of particulate and oily materials) from the surface of a textile and as well as soil build-up which after numerous cycles of usage and washing results in muted colors and grayer white fabric areas. Bleaches are also very useful in reducing the microbial presence on textiles which provides sanitization benefits increasingly desired by consumers.

Typically, peroxygen bleaches capable of yielding hydrogen peroxide in aqueous solutions are used to treat textile and fabric articles and are very effective for removing stains as well as soil materials from textiles. But such bleaching species are also highly temperature dependent as they are effective only in aqueous solutions or wash liquors having a temperature of greater than about 60° C., but becoming less and less effective as the temperature of the solution is lowered below 60° C.; while increasing the concentration of the hydrogen peroxide bleaching species extends the useful effective range of the bleaching species below 60° C., such increases are not only inpracticable for large-scale commercial detergent production but are also ineffective at lower wash temperatures. This temperature dependence of peroxygen bleaches is significant because such bleaches are commonly used as a detergent adjuvant in textile wash processes that utilize an automatic household washing machine at wash water temperatures below 60° C. (particularly in North America and Japan).

A highly effective solution to the low-temperature inefficacy of hydrogen peroxide, is the use of a peroxygen bleach activator that reacts with hydrogen peroxide to form an organic peracid bleaching species. This may occur in situ in a bleaching solution as a result of a perhydrolysis reaction between hydrogen peroxide anions and a bleach activator. Suitable bleach activators are widely disclosed in the consumer laundry detergent art. The bleaching mechanism generally, and the surface bleaching mechanism in particular, in the washing solution are not completely understood. While not intending to be limited by theory, however, it is believed that the bleach activator undergoes nucleophilic attack by a perhydroxide anion, for example from aqueous hydrogen peroxide, to form a percarboxylic acid (the perhydrolysis reaction).

Typically these bleach activators are incorporated into powder or granular detergent products as a particle such as an admixed extrudate or granule. Unfortunately, when they are added as one component of consumer detergent product these peroxygen bleach activators have a tendency to react with other components of the detergent product or the moisture inherently present in the product or ambient moisture in the storage container. This greatly compromises their stability and eventual performance benefits. This instability is exacerbated when the detergent product is stored at higher temperatures. In order to maintain the stability of the activator prior to its use by a consumer it is necessary that the activator-containing particle contain binder materials that not only ensure the physical cohesion of the particle but also inhibit the reaction of the activator with ambient moisture and other detergent components so as to provide stability and permanence to the activator material.

But while this binder material may stabilize the bleach activator, it may also insulate the activator from its use environment that it greatly compromises the rate of dispersion and dissolution of the peroxygen bleach activator in aqueous solution or wash liquor. If bleach activator particles are prevented from dissolving in the wash liquor inside an automatic washing machine then bleaching performance may be nonexistence since there is little or no activator molecules to react with the hydrogen peroxide to form the low-temperature peroxy acid bleaching species. Because dissolution is generally less rapid in cold water, then the bleach activator particles are inhibited from provided their benefits in the very wash environments in which it is most important for them do so.

Accordingly, there is a continuing need for a specially-formulated bleach activator-containing particle which is not only stable during storage in the detergent product box but is also readily soluble in water, particularly relatively water, when added to a wash liquor during an aqueous wash process.

SUMMARY OF THE INVENTION

It has now been discovered in the present invention that the use of specific compounds as well as combinations of such compounds in the binder system of a bleach activator particle can maintain the stability and prevent the degradation of the bleach activator without impeding the rapid and ready dissolution of the particle when added to an aqueous solution or wash liquor, particularly when the temperature of the aqueous solution or wash liquor is relatively cold.

The bleach activator particles according to a first aspect of the present invention comprise a bleach activator having the general formula:

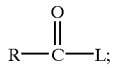

wherein R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a pKα in the range of from about 4 to about 13, preferably from about 6 to about 11, most preferably from about 8 to about 11. In this first aspect, the bleach activator particles also contain a binder material which comprises from about 0.1% to about 15% of an inorganic salt capable of absorbing water of hydration.

In a second aspect of the present invention, the bleach activator particles comprise a bleach activator having the same general activator formula described above as well as a binder material comprising from about 0.1% to about 15% of a saturated fatty acid having the formula:

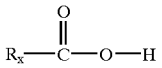

wherein $R_x$ is an alkyl group which contains less than 15, preferably less than about 11, more preferably less than about 9 carbon atoms and wherein the particle contains no saturated fatty acids of the above formula wherein $R_x$ contains more than 15 carbon atoms. It is preferred that these fatty acids be used in combination with polyethylene glycols which are discussed in greater detail below.

In additional aspect, the present invention relates to bleach-containing detergent compositions containing the above described bleach activator and characterized by having a residual weight of less than about 4%, preferably less than about 3%, more preferably less than about 1% as measured by the blue pouch test and a bleach activator stability of at least about 50%, preferably at least about 70%, more preferably at least about 90% as measured by the storage stability test.

All parts, percentages and ratios used herein are expressed as percent weight unless otherwise specified. All documents cited are, in relevant part, incorporated herein by reference.

DETAILED DESCRIPTION OF THE INVENTION

By the phrase "cylindrically-shaped extrudates" it is meant an extruded particle having a surface shape generated by a straight line moving parallel to a fixed straight line and intersecting a fixed planar closed curve.

By the phrase "an effective amount" it is meant a detergent composition containing a bleach activator is any amount capable of measurably improving both soil removal from and sanitization of the fabric when it is washed by the consumer. In general, this amount may vary quite widely.

By "hydroligancy" it is meant the average number of water molecules attached to the cation of an inorganic salt.

The bleach activator particles of the present invention essentially comprises two components: a bleach activator and one or more binder materials which provide cohesion to the activator particle as well as stabilize the bleach activator material during storage prior to use. The activator particles are typically present in a detergent composition in combination with a peroxygen bleaching compound capable of yielding hydrogen peroxide in an aqueous solution. During usage in an aqueous wash process the hydrogen peroxide is combined with a bleach activator which leads to the in situ production in an aqueous solution (i.e. during the laundering process) of the peroxy acid corresponding to the activator. The bleaching mechanism generally, and the surface bleaching mechanism in particular, in the washing solution are not completely understood. While not intending to be limited by theory, however, it is believed that the bleach activator undergoes nucleophilic attack by a perhydroxide anion, for example from aqueous hydrogen peroxide, to form a percarboxylic acid. This reaction is commonly referenced in the art as perhydrolysis.

As for the surface bleaching, it is believed that this mechanism functions by increasing the energy gap between the ground and excited state of a bleach-target molecule so that the molecule absorbs light in the ultraviolet region and thus no color is produced and no photons in the visible portion of the light spectrum are absorbed.

The components of the bleach activator particle, as well as the composition, size and morphology of the particle will now be discussed in greater detail.

Bleach Activators

The bleach activator for the bleaching systems useful herein preferably has the following structure:

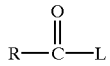

wherein R is an alkyl group containing from about 5 to about 18 carbon atoms and L is a leaving group, the conjugate acid of which has a pKα in the range of from about 4 to about 13, preferably from about 6 to about 11, most preferably from about 8 to about 11.

L can be essentially any suitable leaving group. A leaving group is any group that is displaced from the bleach activator as a consequence of the nucleophilic attack on the bleach activator by the perhydroxide anion. This, the perhydrolysis reaction, results in the formation of the percarboxylic acid. Generally, for a group to be a suitable leaving group it must exert an electron attracting effect. This facilitates the nucleophilic attack by the perhydroxide anion.

The L group must be sufficiently reactive for the reaction to occur within the optimum time frame (e.g., a wash cycle). However, if L is too reactive, this activator will be difficult to stabilize. These characteristics are generally paralleled by the pKa of the conjugate acid of the leaving group, although exceptions to this convention are known.

Preferred bleach activators are those of the general formula:

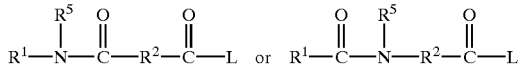

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is selected from the group consisting of:

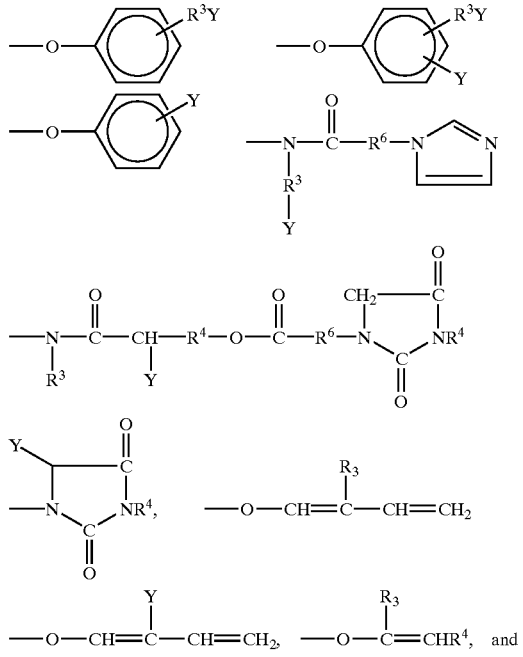

-continued

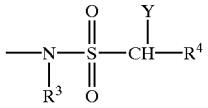

wherein $R^6$ is an alkylene, arylene, or alkarylene group containing from about 1 to about 14 carbon atoms, $R^3$ is an alkyl chain containing from about 1 to about 8 carbon atoms, $R^4$ is H or $R^3$, and Y is H or a solubilizing group. Y is preferably selected from the group consisting of—$SO_3$—M+, —COO—M+, —$SO_4$—M+, (—N+$R'_3$)X- and O←N($R'_3$), wherein R' is an alkyl chain containing from about 1 to about 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is an anion selected from the group consisting of halide, hydroxide, methylsulfate and acetate anions. More preferably, Y is —$SO_3$—M+ and —COO—M+. It should be noted that bleach activators with a leaving group that does not contain a solubilizing group should be well dispersed in the bleach solution in order to assist in their dissolution. Preferred is:

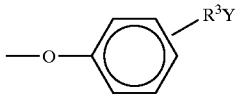

wherein $R^3$ is as defined above and Y is —$SO_3$—M+ or —COO—M+ wherein M is as defined above.

Especially preferred bleach activators are those wherein $R^1$ is a linear alkyl chain containing from about 6 to about 12 carbon atoms. $R^2$ is a linear alkylene chain containing from about 2 to about 6 carbon atoms, $R^5$ is H, and L is selected from the group consisting of:

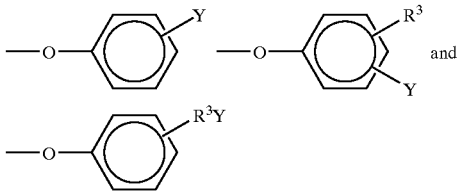

wherein $R^3$ is as defined above, Y is —$SO_3$—M+ or —COO—M+ and M is as defined above.

A preferred bleach activator is:

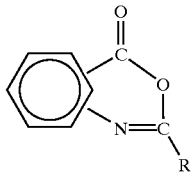

wherein R is H, alkyl, aryl or alkaryl. This is described in U.S. Pat. No. 4,966,723, Hodge et al., incorporated by reference herein.

Preferred bleach activators are:

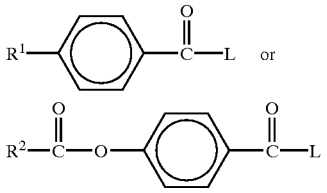

wherein $R^1$ is H or an alkyl group containing from about 1 to about 6 carbon atoms and $R^2$ is an alkyl group containing from about 1 to about 6 carbon atoms and L is as defined above.

Another preferred bleach activator is:

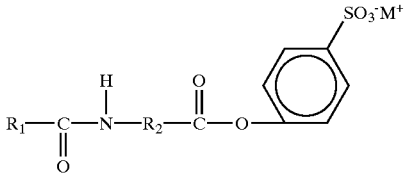

wherein $R_1$ is H or an alkyl group containing from about 1 to about 6 carbon atoms and $R_2$ is an alkyl group containing from about 1 to about 6 carbon atoms.

Preferred bleach activators are also those of the above general formula wherein L is as defined in the general formula, and $R^1$ is H or an alkyl group containing from about 1 to about 4 carbon atoms. Even more preferred are bleach activators of the above general formula wherein L is as defined in the general formula and $R^1$ is a H.

Additional species of suitable bleach activators are disclosed in U.S. Pat. No. 5,795,854, issued Aug. 18, 1998, to Angell et al., which is hereby incorporated by reference.

Also suitable as bleach activators are the various classes of esters, imides, imidazoles, oximes and carbonate bleach precursor compounds disclosed in U.S. Pat. No. 4,444,674, issued Apr. 24, 1984, to Gray et al., which is hereby incorporated by reference. The imide tetraacetylethylenediamine is one notable example.

Binder Materials

The bleach activator particle also comprises binder materials which not only provide cohesion to the activator particles but also stabilize the bleach activator material during storage, prior to its use by preventing reactions between the activator material and other formula components as well as formula and ambient moisture.

The materials that can be utilized as binder materials are nonionic surfactants, polyethylene glycols, fatty acids, anionic surfactants, inorganic and organic salts, film forming polymers, chelants, cationic surfactants, polymeric disintegrating agents and mixtures of these materials. A preferred set of binder materials are nonionic surfactants, polyethylene glycols, fatty acids, anionic surfactants, inorganic salts, film forming polymers and mixtures of these materials. It is preferred that the are selected so as to not be reactive with the bleach activators of the present invention or the components of the detergent compositions into which the bleach activator particles are blended. Generally, these binder materials should have a low hygroscopicity upon storage but should be soluble or dispersable in water, which allows for the ready dispersion and release of the peroxygen bleach activator in an aqueous wash solution. It is also desirable that the employed binder or enrobing materials do not melt below about 40° C. because frequently the storage temperature for such detergent products may reach as high as 40° C.

Examples of nonionic surfactants that can be utilized as binder materials are the condensation products of primary or secondary aliphatic alcohols having from 8 to 24, and preferably about 9 to about 18, carbon atoms, in either a straight or branched chain configuration, with from about 35 to about 100 moles, and preferably about 40 to about 80 moles, of ethylene oxide per mole of alcohol. Additional examples of nonionic surfactant suitable for use as binders are disclosed in U.S. Pat. No. 4,483,778, issued Nov. 20, 1984 to Thompson et al. which is hereby incorporated by reference.

Suitable polyethylene glycols are homopolymers of ethylene oxide have the general formula:

$$HO(C_2H_4O)_nH,$$

and have an average molecular weight of from about 2,000 to about 15,000, preferably from about 3,000 to about 10,000 and most preferably from about 4,000 to about 8,000.

The fatty acids suitable for use in the bodies of the present invention include the saturated fatty acids having the formula:

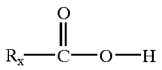

wherein $R_x$ is an alkyl group which contains less than 15, preferably less than about 11, more preferably less than about 9 carbon atoms and wherein the particle contains no saturated fatty acids of the above formula wherein $R_x$ contains more than 15 carbon atoms.

Generally, fatty acids always form part of the binder material composition when it is desired to use polyethylene glycols. This is because fatty acids lower the glass transition temperature (the temperature at which a liquid solidifies into a short-range order solid, such as a glass or amorphous solid) and so act to keep the polyethylene glycol in a viscoelastic state. The fatty acids can also be useful for lowering the pH of the particle to discourage hydrolysis. However, it is also believed that the longer chain fatty acids are partly responsible for the poor dispersability and solubility performance frequently seen in poor dissolving granular laundry detergents. Accordingly, it is an essential part of the present invention that the fatty acids be selected based on the maximum alkyl chain length described above.

Suitable anionic surfactants useful as binder materials in the bodies of the present invention include the water-soluble salts, preferably the alkali metal, ammonium and alkylolammonium salts, of organic sulfuric reaction products having in their molecular structure an alkyl group containing from about 8 to about 20 carbon atoms and a sulfonic or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms), and the sodium and potassium alkylbenzene sulfonates in which the alkyl group contains from about 9 to about 15 carbon atoms in a straight or branched chain configuration. These are described in U.S. Pat. Nos. 2,220,099 and 2,477,383, both incorporated herein by reference. The preferred anionic surfactants are linear straight chain alkylbenzene sulfonates in which the average number of carbon atoms in the alkyl group is from about 11 to 13, abbreviated as $C_{11-13}$ LAS. Additional examples of anionic surfactant suitable for use as binders are disclosed in U.S. Pat. No. 4,444,674, incorporated above.

Also suitable as components of the binder material are the organic and inorganic salts such as acetates, alkali salts of maleic acid, citrates, aluminosilicates, sulfates, carbonates, hydrogen phosphates, pyrophosphates, tetraborates, thiosulfates and mixtures thereof. Inorganic salts are preferred and particularly preferred are sodium and magnesium sulfate salts. These salts are particularly useful when water is a component of the binder material because by incorporating free water into their crystal structure they reduce the amount of free water in the bleach activator particle and the overall detergent composition. As discussed in greater detail below, free water can contribute to bleach activator instability.

Suitable film forming polymers useful as binder materials in the bodies of the present invention are the polymers derived from the monomers such as vinyl chloride, vinyl alcohol, furan, acrylonitrile, vinyl acetate, methyl acrylate, methyl methacrylate, styrene, vinyl methyl ether, vinyl ethyl ether, vinyl propyl ether, acrylamide, ethylene, propylene and 3-butenoic acid. Preferred polymers of the above group are the homopolymers and copolymers of acrylic acid, hydroxyacrylic acid, or methacrylic acid, which in the case of the copolymers contain at least about 50%, and preferably at least about 80%, by weight, units derived from the acid. The particularly preferred polymer is sodium polyacrylate. Other specific preferred polymers are the homopolymers and copolymers of maleic anhydride, especially the copolymers with ethylene, styrene and vinyl methyl ether. These polymers are commercially available under the trade names Versicol and Gantrez. Other film-forming polymers useful as binder or enrobing materials in the bodies of the present invention are disclosed in U.S. Pat. No. 4,486,327, incorporated above.

The binder material may also optionally comprise one or more chelating agents. Such chelating agents can be selected from the group consisting of amino carboxylates, amino phosphonates, polyfunctionally-substituted aromatic chelating agents and mixtures therein, all as hereinafter defined.

Amino carboxylates useful as optional chelating agents include ethylenediaminetetracetates, N-hydroxyethylethylenediaminetriacetates, nitrilo-triacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartnan and Perkins.

The compositions herein may also contain water-soluble methyl glycine diacetic acid (MGDA) salts (or acid form) as a chelant or co-builder. Similarly, the so called "weak" builders such as citrate can also be used as chelating agents.

The binder material may also comprise polymeric disintegrating agents which are capable of accelerating the dissolution of the bleach activator material. In a preferred embodiment, the disintegrating agent comprises a polymeric material which is a so called water-swellable polymer, capable of absorbing water and increasing thereby its volume. It may thus be preferred that the disintegrating agent is only partially water soluble or substantially not water soluble.

The disintegrating agent comprises preferably one or more polymers selected from the group comprising cross-linked polymers of polyvinyl pyrrolidone, cross-linked copolymers of polyvinyl pyrrolidone, starch, modified starch, including pregelatinised starch and sodium starch gluconate, gum, cellulose, modified cellulose, preferably cross-linked cellulose, cross-linked cellulose derivatives, hydroxyalkyl cellulose, microcrystalline cellulose, microcrystalline cellulose derivatives, microcrystalline crosslinked cellulose, compacted cellulose, compacted modified cellulose such as compacted cellulose derivatives or compacted cross-linked cellulose, or mixtures thereof.

Morphology, Size, Composition and Usage of the Bleach Activator Particles

Preferably the bleach activator particles prepared according to the present invention will be substantially cylindrically-shaped extrudates. These cylindrically-shaped extrudates have a mean extrudate length of from about 500 microns to about 3500 microns, more preferably from about 700 microns to about 3000 microns, and most preferably from about 900 microns to about 2500 microns. Preferably, the mean extrudate diameter is from about 450 microns to about 1000 microns, more preferably from about 500 microns to about 950 microns, and most preferably from about 550 microns to about 900 microns. The advantages of the cylindrical morphology and the advantages of the above-specified particle sizes as well as techniques for obtaining average diameter and length measurements are disclosed in the U.S. Pat. No. 5,795,854, incorporated above.

In the present invention the bleach activator particles will comprise from about 5% to about 50%, preferably from about 4% to about 30%, and more preferably from about 1% to about 15% of the binder material and from about 50% to about 95%, preferably from about 60% to about 85% of the bleach activator. Typically the binder material will be composed of water and an inorganic salt plus other components, or it will be composed of polyethylene glycols and fatty acids (as described above) plus other components; it is undesirable to include water, inorganic salts, polyethylene glycols and fatty acids all in the same binder material.

When the activator particle is used, as will be most typical, in a laundry detergent composition, it is preferable that the detergent composition contain less than about 3%, more preferably less than about 2.5%, and most preferably less than about 2% by weight of free water. While not wishing to be bound by theory, it is believed that by maintaining this relatively low level of free water in the composition, the propensity of the bleach activator to degrade via hydrolysis prior to use is lowered. Thus, the stability of the bleach activator is enhanced and prolonged even further as a result of a selected free water level as set forth herein. Likewise, the bleach activator particle itself should not contain more than 2% water.

In a highly preferred embodiment of the invention, the bleach activator particles consist essentially of, by weight of the particle, from about 70% to about 95% of a bleach activator, from about 0.1% to about 15% of an inorganic salt, from about 0.1% to about 15% of a detersive surfactant (preferably anionic) and less than 2% water. This formulation has been shown to both maintain the stability of the bleach activator while also encouraging dispersion and dissolution when added to an aqueous wash liquor. Although this formulation contains water, most of this water is probably not free water but rather is present as bound water in the crystal lattice of the inorganic salt.

In another highly preferred embodiment of the invention, the bleach activator particles consist essentially of, by weight of the particle, from about 65% to about 95% of a bleach activator, from about 0.1% to about 15% of polyethylene glycol, from about 0.1% to about 15% of a detersive surfactant (preferably anionic) and from about 0.1% to about 5% of fatty acids as described above, wherein the fatty acids contain less than 16 carbon atoms, preferably less than 11 carbon atoms, more preferably less than 11 carbon atoms and still more preferably less than 10 carbon atoms. This formulation also has been shown to both maintain the stability of the bleach activator while also encouraging dispersion and dissolution.

Detergent compositions prepared according to the present invention will contain from about 0.01% to about 40%, preferably from about 1% to about 25%, more preferably from about 2% to about 10% of the bleach activator particles described herein.

Processes for Making the Bleach Activator Particles

In the first step for producing activator particles, the above described activator and binder materials are thoroughly mixed together in a lab scale mixer such as Cuisinart® or in conventional industrial scale mixers such as a Lödige CB mixer or similar type mixer to form an activator/binder mixture. Depending on the desire of the formulator, the mixture may or may not be heated during mixing.

The resulting binder/activator mixture is sufficiently densified that it can be subject to an extrusion process. Production of activator particles by extrusion is specifically discussed in U.S. Pat. No. 4,486,327, incorporated above.

Thus, in a second step, the densified activator/binder material mixture is forced through an orifice in a die plate in an extruder (preferably a screw-type extruder) to produce long strands of bleach activator-containing material that is sufficiently plasticized to be easily cut into extrudates.

When a polyethylene glycol and a fatty acid are the base components of the binder material, it may be necessary to heat activator/binder mixture before extrusion. After extruding this material, the strand is cooled, the strands cut into extrudates, and readied to be admixed with other detergent granules.

When water and an inorganic salt (e.g. sulfate) are the base components of the binder material, the resulting friction and dissipation of mechanical energy during extrusion of the activator/binder mixture will cause an increase in the temperature of the die plate which will in turn cause evaporation of some of the water content of the activator/binder material. To reduce the water content further it may even be desirable to heat the die plate to a temperature above or significantly above the hydration temperature of the inorganic salt in the activator/binder mixture (where it is assumed most of the water is located). The activator/binder mixture is then cooled, dried (optionally), and cut or grinded into extrudates. If desired, this drying may take place at a high temperature to eliminate as much of the water of hydration from the inorganic salt as possible. By this latter step, the inorganic salts may be at least partially "dehydrated"—that is coordination locations for forming water ligands in the crystal structure may be made available so that during storage of the activator particles, the inorganic salts may serve as "sinks" to absorb moisture from the atmosphere or the other particles in the granular product thus providing further stabilizing benefits to the bleach activator particle.

In a less preferred option, regardless of the exact content of the binder material, the extrusion step can be avoided and the bleach activator particles can be obtained by standard drying and agglomeration techniques.

Optionally, a finely divided inorganic powder may be added as a flow aid to the surface of the extrudates to yield acceptable flow properties for bulk handling of the extrudates or particles. This flow aid includes, but is not limited to, finely divided aluminosilicates, silicas, crystalline layered silicates, MAP zeolites, amorphous silicates, sodium carbonate, and mixtures thereof. It is preferable for the level of the flow aid to be from about 0.1% to about 10%, more preferably from about 1% to about 7%, and most preferably from about 1.5% to about 5% by weight of the detergent composition. The most preferable flow aid is aluminosilicate.

The Peroxygen Bleaching Compound

The peroxygen bleaching systems useful herein are those capable of yielding hydrogen peroxide in an aqueous liquor. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired.

Preferred peroxygen bleaching compounds include sodium perborate, commercially available in the form of mono-, tri-, and tetra-hydrate, sodium pyrophosphate peroxyhydrate, urea peroxyhydrate, sodium percarbonate, and sodium peroxide. Particularly preferred are sodium perborate tetrahydrate, sodium perborate monohydrate and sodium percarbonate. It is believed that such rapid dissolution results in the formation of higher levels of percarboxylic acid and, thus, enhanced surface bleaching performance.

Highly preferred percarbonate can be in uncoated or coated form. The average particle size of uncoated percarbonate ranges from about 400 to about 1200 microns, most preferably from about 400 to about 600 microns. If coated percarbonate is used, the preferred coating materials include mixtures of carbonate and sulphate, silicate, borosilicate, or fatty carboxylic acids.

The peroxygen bleaching compound will comprise at least about 0.1%, preferably from about 1% to about 75%, more preferably from about 3% to about 40%, most preferably from about 3% to about 25%, by weight of the detergent composition. Also, the detergent composition comprises from about 0.1% to about 40%, more preferably from about 5% to about 15%, and most preferably from about 10% to about 15%, by weight of the bleach activator. Optionally, one or more adjunct bleach activators may be used in the same amounts.

The weight ratio of bleach activator to peroxygen bleaching compound in the bleaching system typically ranges from about 2:1 to 1:5. Preferred ratios range from about 1:1 to about 1:3. The molar ratio of hydrogen peroxide yielded by the peroxygen bleaching compound to the bleach activator is greater than about 1.0, more preferably greater than about 1.5, and most preferably from about 2.0 to about 10. Preferably, the bleaching compositions herein comprise from about 0.5 to about 20, most preferably from about 1 to about 10, wt. % of the peroxygen bleaching compound.

Additionally, the specific bleach activator and peroxygen bleaching composition in the detergent composition are preferably present at specific molar ratios of hydrogen peroxide to bleach activator. Such compositions provide extremely effective and efficient surface bleaching of textiles which thereby remove stains and/or soils from the textiles. Such compositions are particularly effective at removing dingy soils from textiles. Dingy soils are soils that build up on textiles after numerous cycles of usage and washing and, thus, result in a white textile having a gray tint. These soils tend to be a blend of particulate and greasy materials. The removal of this type of soil is sometimes referred to as "dingy fabric clean up". The bleach-containing detergent compositions of this invention provide such bleaching over a wide range of bleach solution temperatures. Such bleaching is obtained in bleach solutions wherein the solution temperature is at least about 5° C. Without the bleach activator, such peroxygen bleaches would be ineffective and/or impracticable at temperatures below about 60° C.

Means for Assessing Activator Characteristics

The solubility performance of detergent compositions containing bleach activator particles prepared according to the present invention may be assessed by means of one particular test for analyzing the performance and consumer acceptance of a granular laundry detergent, the blue pouch dissolution test. In this test a sample of powdered detergent is placed in a pouch and run through the wash cycle of a machine. The test involves the use of multiple fabric pouches, typically 4 inch by 8 inch blue fabric rectangles (C72 Blue—Available from EMC Empirical Manufacturing Co.) sewn together on three sides of the pouch. A fully formulated detergent of the recommended dose is placed in the pouch and the pouch is sealed. In order to maintain accuracy in the test a minimum level of bleach activator is required. Therefore if the fully formulated detergent contains less than 7.5%, by weight, of bleach activator particles, the test should be conducted by increasing the level of the bleach activator to 7.5% (by diluting the formula). A standard washing machine is filled with 22.0 gallons of 40° F. water at 6 grains per gallon hardness and run on a 12 minute heavy duty cycle. The pouches are removed at the end of a complete wash cycle. The pouches are weighed and the results analyzed by calculating the ratio of residual weight to starting weight of the bleach activator particle. For example, if the pouch contained 5 grams of bleach activator particles after being sealed and then weighs 1 gram at the end of the complete wash cycle (after accounting for any water trapped in the fabric of the pouch), then the residual weight is 20%.

For superior performing products, it has been found that the blue pouch residue, by weight, is less than about 50%, preferably less than about 35%, more preferably less than about 15% after the completion of the cycle.

The stability performance of detergent compositions containing bleach activator particles prepared according to the present invention may be assessed by means of the storage stability test. For this test, four samples of 20 grams of a granular detergent composition containing sodium nonanoyloxybenzene sulfonate bleach activator are individually placed into separate glass jars and sealed. Each of the four glass jars are mixed by rotating the jars in planetary motion.

The jars are then opened an placed in a controlled environment room maintained at 80° F. (26.7° C.) and 60% relative humidity. Two samples are pulled at 0, 2, 4, and 8 weeks. The contents of the jars are analyzed for bleach activator (i.e., NOBS) level. In the present invention, the stability parameter is the amount of bleach activator remaining after 8 weeks.

For superior performing cleaning products, it has been found that there is at least about 50%, preferably at least about 70%, more preferably at least about 90% active bleach activator material remaining at the end of 8 weeks.

Adjunct Detergent Ingredients

The bleach activator/bleaching compound systems herein are useful per se as bleaches. However, such bleaching systems are especially useful in compositions which can comprise various detersive adjuncts such as surfactants, builders and the like.

Preferably, adjunct detergent ingredients selected from the group consisting of enzymes, soil release agents, dispersing agents, optical brighteners, suds suppressors, fabric softeners, enzyme stabilizers, perfumes, dyes, fillers, dye transfer inhibitors and mixtures thereof are included in the composition of the invention. The following are representative nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+l) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS^M$; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$-$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

In addition to a detersive surfactant, at least one suitable adjunct detergent ingredient such as a builder is preferably included in the detergent composition. For example, the builder can be selected from the group consisting of aluminosilicates, crystalline layered silicates, MAP zeolites, citrates, amorphous silicates, polycarboxylates, sodium carbonates and mixtures thereof. Other suitable auxiliary builders are described hereinafter.

Preferred builders include aluminosilicate ion exchange materials and sodium carbonate. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

Composition Use

An effective amount of the detergent compositions herein added to water in a washing apparatus (which encompasses automatic washing machines as well as a kitchen or bathroom sink and equivalent devices) to form aqueous laundering/bleaching solutions can comprise amounts sufficient to form from about 500 to 10,000 ppm of composition in aqueous solution. More preferably, from about 800 to 8,000 ppm of the detergent compositions herein will be provided in aqueous washing/bleaching solution.

In order to make the present invention more readily understood, reference is made to the following examples, which are intended to be illustrative only and not intended to be limiting in scope.

EXAMPLE I

A bleach activator extrudate suitable for admixing with other granules of a detergent matrix are prepared in the following way. Sodium nonanoyloxybenzene sulfonate ("NOBS") in powder form is added to a lab mixer (such as a Cuisinart® Food Processor). LAS in a high active form and PEG 4000 are added next. The lab mixer is then turned on, and nonanoic acid is added to the contents during mixing. The material is mixed for 2 minutes or until the components are well dispersed as indicated by a reduction in material dustiness. The resulting mixture contains 85% NOBS, 7.5% polyethylene glycol (MW=4000), 4.5% of sodium linear alkylbenzene sulfonate surfactant ("LAS"), and 3% of nonanoic acid ($C_9$ fatty acid).

This mixture is collected and placed in microwave. It is then heated above 140° F. in order to melt the binder/enrobing components. The material is then fed to a lab extruder (Fuji Paudel Co. Ltd. Dome Granulator. DG-L1) and extruded through a 600 micron diameter die. Extruded material is collected and cooled to a form a non-sticky, free flowing extrudate. It is then sized to a mean length of 2000 microns. The extrudates may now be admixed into a bleach-containing detergent composition.

Using the above method, about 600 grams of the material may be made. The extrudates are then blended into a bleach-containing detergent composition having the following formula:

| Component | Weight % |
|---|---|
| $C_{16}$ branched alkyl sulfate | 6.7 |
| $C_{12-16}$ linear alkylbenzene sulfonate | 2.8 |
| $C_{14-15}$ alkyl sulfate | 4.5 |
| Polyacrylate (MW = 4500) | 1.3 |
| Polyethylene glycol (MW = 4000) | 1.6 |
| Sodium Sulfate | 1.1 |
| Aluminosilicate | 34.5 |
| Sodium carbonate | 16.9 |
| Protease enzyme | 0.1 |
| Sodium percarbonate | 3.6 |
| NOBS extrudate particles | 7.8 |
| Effervescence Particle[1] | 9.3 |
| Free water | 8.0 |
| Minors (bound water, perfume, etc.) | 1.1 |
| | 100.0 |

[1]The effervescence particle is composed of 66% citric acid and 34% sodium carbonate. Such compositions are described in greater detail in the copending provisional application of Erin M. Lilley et al., P&G Case No. 7847P, having been filed on October 28, 1999, which is hereby incorporated by reference.)

Unexpectedly, the compositions have improved solubility and NOBS extrudate stability during storage. For example, pouch testing of the above formula produces a visually clean pouch and a blue pouch residue of 7% by weight.

EXAMPLE II

Bleach activator extrudates suitable for admixing with other granules of a detergent matrix are prepared in the following way. LAS and sodium sulfate are well mixed with water lab mixer (Cuisinart® Food Processor) to form a sticky paste. NOBS in a powder form is added to the mixer. The high sheer mixer is turned on, and the LAS/sulfate/water paste is added to the powder during mixing. The material is mixed for 2 minutes or until the components are well dispersed as indicated by a reduction in material dustiness. After mixing but prior to extrusion the material has the following composition: 82% NOBS; 9% LAS (91% active); 3% sodium sulfate monohydrate and 6% water. The material is then fed to a lab extruder and extruded through a 600 micron diameter die.

The extruded material forms long noodles and is sticky with poor flow properties. The material is collected and dried at 140° F. until the moisture, as measured by a Metler moisture meter is less than 2%. The resulting material is a non-sticky, free flowing extrudate. It is then sized to a mean length of 2000 microns. The finished products extrudates have the following composition: 86% NOBS; 10% LAS; 3% sodium sulfate monohydrate and ≦1% water. Using the above method, about 600 grams of the material may be made. Also magnesium sulfate may be substituted for sodium sulfate at the same levels without requiring a modification in any of the above process parameters. The extrudates are then blended into a bleach-containing detergent composition formula enumerated above.

Unexpectedly, the compositions have improved solubility and NOBS extrudate stability during storage. For example, pouch testing of the above formula produces a visually clean pouch and a blue pouch residue residue of 9% by weight.

EXAMPLE III

Bleach activator extrudates suitable for admixing with other granules of a detergent matrix are prepared in the following way. NOBS, sodium sulfate monohydrate, LAS and water are fed to a high shear mixer (BEPEX® Turbulizer, 1300 rpm). The components are mixed until well dispersed. The Resulting mixture is fed into a 6 inch diameter BEPEX® Extrudomix unit and extruded at 140 rpm. After mixing but prior to extrusion the mixture has the following composition: 85% NOBS; 9% LAS; 3% sodium sulfate monohydrate and 3% water.

Optionally, the formulator may desire using a drying step could be added to reduce the water content of the hydrate sulfate salt. Water is driven off by heating the mixture in excess of the hydration temperature of the sulfate/water hydrates.

Extruded material is then collected and, if necessary where it has been heated, cooled to a form a non-sticky, free flowing extrudate. It is then sized to a mean length of 2000 microns. The extrudates may now be admixed into a bleach-containing detergent composition.

What is claimed is:

1. A bleach activator particle comprising:

(a) a bleach activator having the general formula:

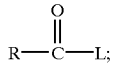

wherein R is an alkyl group containing from about 5 to about 18 carbon atoms and L is a leaving group, the conjugate acid of which has a pKα in the range of from about 4 to about 13; and (b) a binder material comprising train about 0.1% to about 15%, by weight of the particle of a saturated fatty acid having the formula:

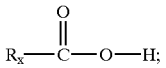

wherein $R_x$ is an alkyl group which contains up to 15 carbon atoms; said bleach activator particle containing no saturated fatty acids of the formula:

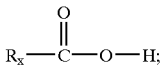

wherein $R_x$contains more than 15 carbon atoms.

2. A particle according to claim 1 wherein the binder material comprises a material selected from the group consisting of an anionic surfactant, polyethylene glycols, and mixtures thereof.

3. A particle according to claim 1 wherein the level of bleach activator, based on bleach activator particle weight, is from about 60% to about 95%.

4. A particle according to claim 1 wherein the level of bleach activator is from about 65% to about 95%, by weight of the particle, and the binder material consists essentially of, by weight of the particle:

(a) from about 0% to about 15% of a polyethylene glycol;

(b) from about 0.1% to about 15% of a detersive surfactant; and (c) from about 0.1% to about 15% of saturated fatty acids having a formula:

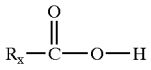

wherein $R_x$ is an alkyl group which contains up to 15 carbon atoms.

5. A particle according to claim 1 wherein the particle is in the form of a substantially cylindrically-shaped extrudate having a mean extrudate length of from about 500 microns to about 3500 microns and a mean extrudate diameter of from about 450 microns to about 1000 microns.

6. A particle according to claim 1 wherein R is a linear alkyl chain containing from about 5 to about 9 carbon atoms and L is selected from the group consisting of:

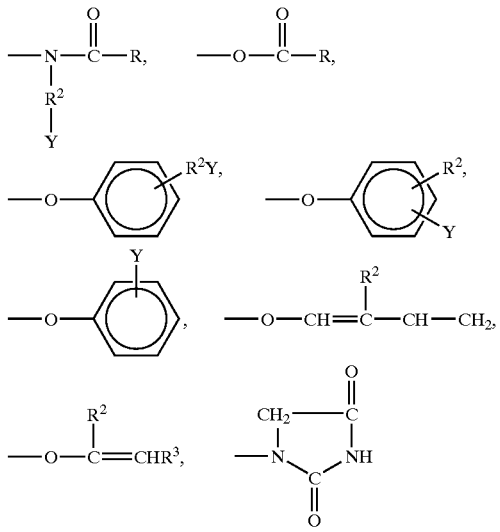

wherein $R^2$ is a linear alkyl chain containing from about 2 to about 6 carbon atoms, $R^3$ is an alkyl chain containing from about 1 to about 8 carbon atoms, and Y is $—So_3^-M^+$or $—CO_2^-M^+$wherein M is an alkali metal, ammonium or substituted ammonium cation.

7. A detergent composition comprising:

(a) from about 1% to about 75%, based on weight of the detergent composition, of a peroxygen bleaching compound capable of yielding hydrogen peroxide in an aqueous solution; and (b) a sufficient amount of a particle according to claim 1 to provide, based on weight of the detergent composition, from about 0.1% to about 40% of a bleach activator.

8. A detergent composition comprising, based on weight of the detergent composition, from about 0.1% to about 25% of the bleach activator particle of claim 1.

* * * * *